United States Patent [19]

Shackelford

[11] 4,209,825

[45] Jun. 24, 1980

[54] LAMP

[75] Inventor: John T. Shackelford, Tulsa, Okla.

[73] Assignee: Optronics, Inc., Fort Gibson, Okla.

[21] Appl. No.: 864,600

[22] Filed: Dec. 27, 1977

[51] Int. Cl.[2] ..... F21V 7/00

[52] U.S. Cl. ..... 362/299; 362/303; 362/308; 362/328; 362/329; 362/332; 362/360

[58] Field of Search ..... 362/298, 293, 299, 303, 362/308, 309, 310, 311, 317, 328, 329, 332, 361, 351, 355, 360

[56] References Cited

U.S. PATENT DOCUMENTS

| | | | |
|---|---|---|---|
| 1,288,124 | 12/1918 | Muckenhirn | 362/317 X |
| 1,561,149 | 11/1925 | Gage | 362/317 X |
| 1,770,738 | 7/1930 | Handy | 362/361 X |
| 1,800,935 | 4/1931 | Giddo | 362/351 |
| 1,969,714 | 8/1934 | Burger | 362/329 X |
| 2,202,590 | 5/1940 | Korengold | 362/328 |
| 2,220,145 | 11/1940 | Cooke | 362/332 |
| 2,304,861 | 12/1942 | Thee | 362/317 |
| 2,489,172 | 11/1949 | Brandt | 362/361 X |
| 2,798,147 | 7/1957 | Orsatti | 362/332 X |
| 3,754,135 | 8/1973 | Hulbert, Jr. | 362/303 X |
| 4,142,229 | 2/1979 | Hulbert, Jr. | 362/309 X |

*Primary Examiner*—Peter A. Nelson

*Attorney, Agent, or Firm*—James H. Chafin

[57] ABSTRACT

A lamp having a treated lense for reducing peripheral glare thereby making the lamp useful as a driving light, fog light or spotlight. The treated lense is provided with opaque pigment around the periphery of the lense and the center portion thereof to form elliptical shaped aperture for more acutely defining the desired beam pattern.

13 Claims, 7 Drawing Figures

LAMP

BACKGROUND OF THE INVENTION

1. Field of the Invention

The present invention relates to electric lamps and more particularly, but not by way of limitation, to a lamp having a treated lense to reduce peripheral glare primarily for use as automobile or vehicle driving lamps, spotlights or the like.

2. History of the Prior Art

There is a well developed history of utilization of lamps for spotlights or driving lamps where the lamp includes an internal parabolic reflecting surface for collecting the light emission from a bulb or resistive element located near the focus of the parabolic surface, collimating the light into a beam which is directed through the lense or suitable transparent media to illuminate a specific viewing area.

Since the lense is usually refractive and the parabolic surface is often slightly open to provide a desired beam pattern, there exists peripheral illumination outside of the beam width in which the light is less intense and which is even desirable for many ordinary uses.

However, when such lamps are used as driving lights for vehicles in fog, smoke or rainy conditions, reflection from the peripheral illumination is distractive and actually impairs visibility in the desired viewing area.

A particularly successful attempt was made to overcome the above disadvantages by the patent to Hulbert, U.S. Pat. No. 3,754,135, issued Aug. 21, 1973, for "Light Treating Means." The Hulbert device teaches the treating of the light by coating specific areas of the lense with a blue translucent pigment whereby the teaching indicates that a "light mixing" takes place which serves to change the color spectrum and to reduce glare. While glare is in fact reduced by the Hulbert device, a great amount of peripheral illumination is still present which can and does present some problems when the lamp is used in conditions of fog, smog, rain or on wet surface.

On the other hand, by utilizing the blue mixed light, there is an enhancement in color differentiation and object identification within the illuminated beam pattern of light.

Another problem exists with the Hulbert device when used as a vehicle head lamp that is that the primary beam is surrounded by a reflected blue halo during use in highly reflective environments which can be distractive to approaching motorists as well as to the driver of the vehicle. Also, since the Hulbert lamp appears blue during daylight conditions as well as when used in a highly reflective environment, its use is prohibited under many state laws in which blue has been adopted for use by law enforcement vehicles only.

SUMMARY OF THE INVENTION

The present invention provides a lamp which has been particularly designed to produce a substantially white light which illuminates a defined area and wherein the peripheral illumination is virtually eliminated.

The present invention utilizes a lamp whereby the lense element of that lamp is treated in order to more acutely define the beam pattern and thereby reduce glare. The outer peripheral lense element which is usually circular in shape (but need not be) is coated with an opaque pigment which may be black, leaving an elliptical shaped aperture with the major axis thereof being horizontally oriented. The center portion of the lense is then coated in a like manner to provide an elliptical shaped opaque center portion, again with its major axis being horizontal. This provides an elliptical shaped light aperture in which the lense is untreated.

In order to coat the lense in a manner so that the coating is durable, the areas to be coated are first frosted by either etching or sandblasting. The pigment is then applied to the frosted area. The resulting lamp provides a more acutely defined beam pattern than that of the blue coated lamp or the untreated lamp even though there is a reduction in the ability to distinguish color of objects within the beam pattern. Since the beam pattern is more acutely defined, incident light is reduced and the edge glare is virtually eliminated.

Testing has revealed that the center portion of the translucent blue coated bulb has incident light surrounding the main beam pattern, whereas, the black or opaque coated lamp has a very defined main beam pattern.

In summary, the black or opaque coated lense will not produce the same effects as the blue such as color identification and objection definition but the beam pattern will eliminate the glare thereby making the present invention more desirable as a driving light in highly reflective conditions.

Other tests have indicated that by similarly coating the clear lense, one with a blue translucent coating and the second with opaque coating, the blue unit has approximately 28% less maximum output than the clear lense while reducing peripheral or stray light by an amount of some 50%. The opaque light compared with the blue light displayed 90% of the intensity of the blue light but only 30% of the stray light. Hence one might deduct that the peripheral light or stray light from the opaque treated lense would amount to 15% of that present in a clear or untreated bulb while still maintaining approximately 65% of the intensity output in the desired viewing area.

Hence, it was determined that the lamp with the opaque treated lense as taught by the present invention was significantly superior over either the clear lense or the blue coated lense when used as a vehicle auxiliary driving lamp.

DESCRIPTION OF THE DRAWINGS

Other and further advantageous features of the present invention will hereinafter more fully appear in connection with the detailed description of the drawings in which.

DETAILED DESCRIPTION OF THE PREFERRED EMBODIMENT

Figure 1:
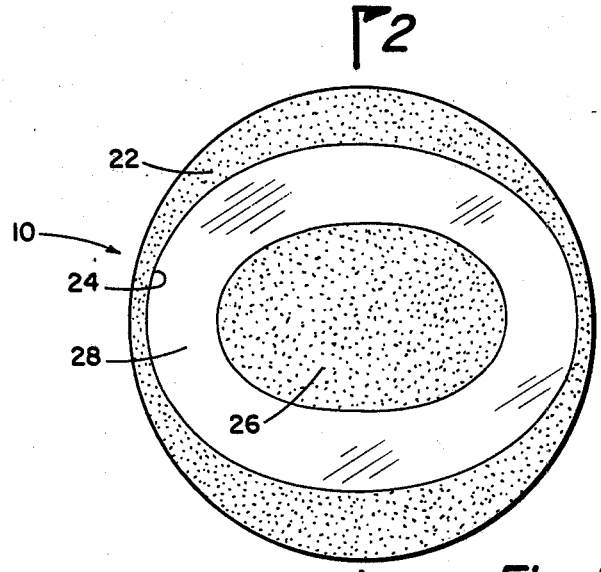
FIG. 1 is a front elevational view of a lamp embodying the present invention.
Figure 2:
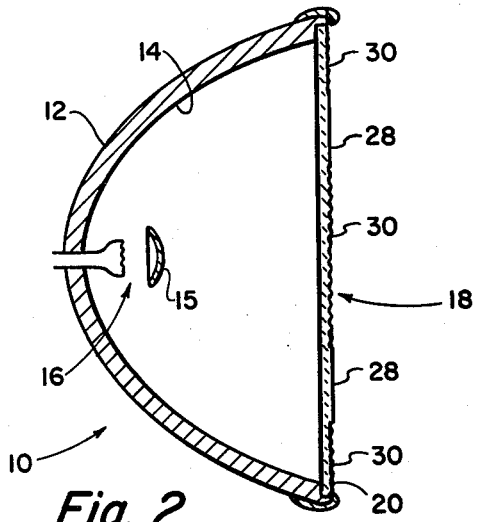
FIG. 2 is a sectional view of the lamp of FIG. 1 taken along the broken lines 2—2 of FIG. 1.

Referring to the drawings in detail reference character 10 generally indicates a lamp which may or may not be of a sealed beam type having a lamp body 12, the inside surface 14 thereof being reflective and in the shape of the parabaloid. The lamp 10 also comprises a light emitter which is normally of a resistive element type indicated by reference character 16 and is normally located near the focus of the parabolic surface 14. The light emitter is provided with a filament shield 15. The parabolic surface 14, upon receipt of the light from the light emitter 16, reflects that light or collimates the light into a beam which is then transmitted through a lense or transparent media generally indicated by reference character 18 being disposed to cover both the reflecting surface 14 and the light emitter 16.

Although the lense need not be constructed of glass material, glass material is a common media for the lense and is indicated by reference character 20. The front surface of the lense 20 is then treated in the following manner:

First, the specific areas of the lense to be coated are frosted by either an etching process or by sandblasting, the first such frosted area being represented by reference character 22 and covering the outer peripheral area of the lense leaving an enlarged elliptical shaped aperture 20 therein. A second center portion of the lense 26 is frosted in a like manner and in the shape of an ellipse which is concentric within the elliptical aperture resulting from the frosted area 22.

After the areas 22 and 26 have been frosted, there remains an elliptical shaped untreated area 28 which will be referred to as an elliptical shaped aperture. After the areas 22 and 26 have been frosted they are coated with an opaque pigment which may be black, but not limited to black and is indicated by reference character 30.

Figure 4:
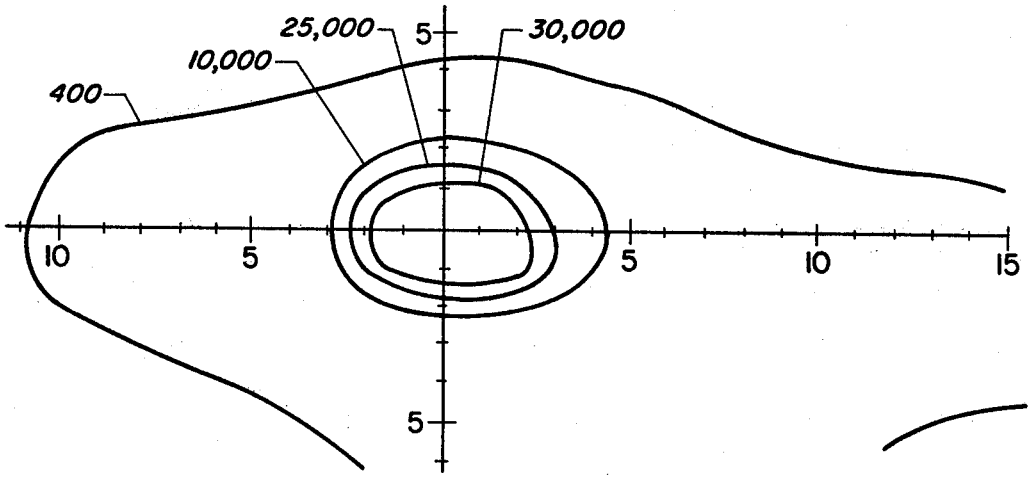
FIG. 4 is a beam pattern diagram of a lamp treated with translucent blue pigment.
Figure 5:
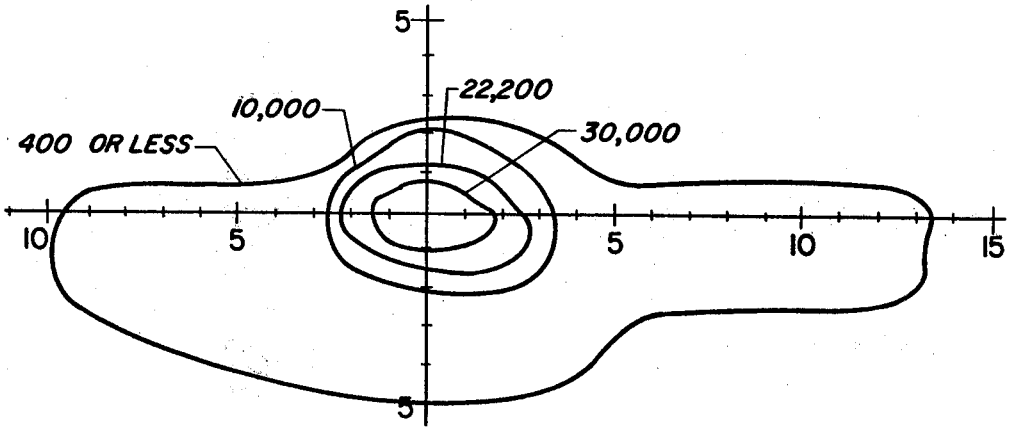
FIG. 5 is a beam pattern diagram of a lamp embodying the present invention.
Figure 3:
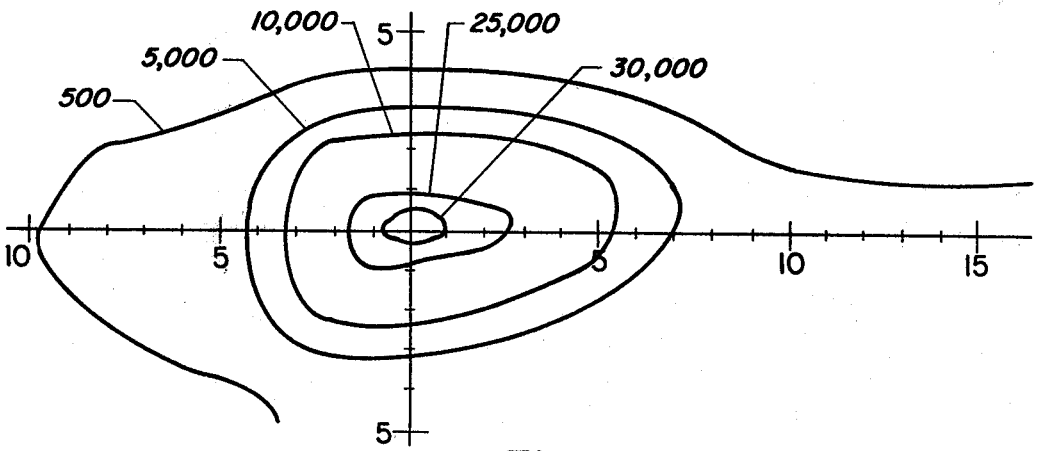
FIG. 3 is a beam pattern diagram of an untreated lamp.

Referring now to FIGS. 3, 4 and 5, FIG. 3 represents a beam pattern of an Optronics 7706 bulb having an untreated or clear lense. It is noted at the outset that the subject 7706 lamp has provided in the lense, an array of facets or flutes for refracting portions of the beam to make the lamp suitable as a driving lamp. For instance as shown in FIG. 3, the left portion of the pattern is somewhat chopped to control the amount of peripheral light to the left and is particularly designed for use as a vehicle driving lamp in areas where vehicles are driven in the right hand lanes of traffic. This chopping prevents excessive beam pattern into opposing lanes of traffice. Further, by way of definition, each of the patterns displayed in FIGS. 3, 4 and 5 are conducted with an Optronics 7706 lamp treated in the methods that have been heretofore described. The contours depicted in the beam patterns are in foot-candles and represent light intensity over the various contours.

It can be seen that the primary beam pattern consisting of 10,000 foot-candles or greater for the clear bulb as shown in FIG. 3 extends some 3½° to the left, 5½° to the right, 2½° upward and just over 3° downward. It can also be seen that peripheral light represented by the 500 foot-candle contour extends some 10° to the left 4° upward, is off the chart in a downward direction and again off the chart in a right-hand direction. This peripheral light represents the peripheral illumination giving rise to edge glare when used in a reflective environment such as fog, smoke, rain, snow and the like.

Referring now to FIG. 4, which is representative of a translucent blue coated bulb, it can be seen that the primary beam pattern represented by 10,000 foot-candles or greater extends almost 3° to the left, 4½° to the right, 2½° upward and approximately 2½° downward. Peripheral light of 400 foot-candles or greater is shown as extending some 11° to the left, 4½° upward, off the chart in a downward direction and also off the chart in the right-hand direction.

Referring now to the beam pattern of FIG. 5, which represents the pattern provided by a bulb having been treated in accordance with the teachings of the present invention, the primary beam pattern represented by 10,000 foot-candles or greater extends some 2½° to the left, 3½° to the right, 2° upward and 2° downward. This represents a more defined primary beam pattern than either the blue coated bulb or the untreated bulb. A contour of 400 foot-candles or less has been plotted on the beam pattern of FIG. 5 showing that contour to extend some 9½° to the left, 13½° to the right, 2½° upward, and 5° downward.

It can also be seen that the 400 foot-candle contour for the beam pattern depicted in FIG. 5 more tightly conforms to the directional axis on the upper side of the pattern. Stated another way, from approximately 3° to 9½° to the left of center, the 400 foot-candle contour extends less than 1° in an upward condition as is the case from between 5° to 13° to the right of center. It is also noted that this area is the area most likely to provide poor visibility when used in highly reflective conditions.

It can be seen by comparing the three beam patterns provided, that the coatings applied in the teachings of the present invention provides a more acute and distinct beam pattern which greatly eliminates edge glare which is produced by peripheral light surrounding the main beam pattern.

Figure 6:
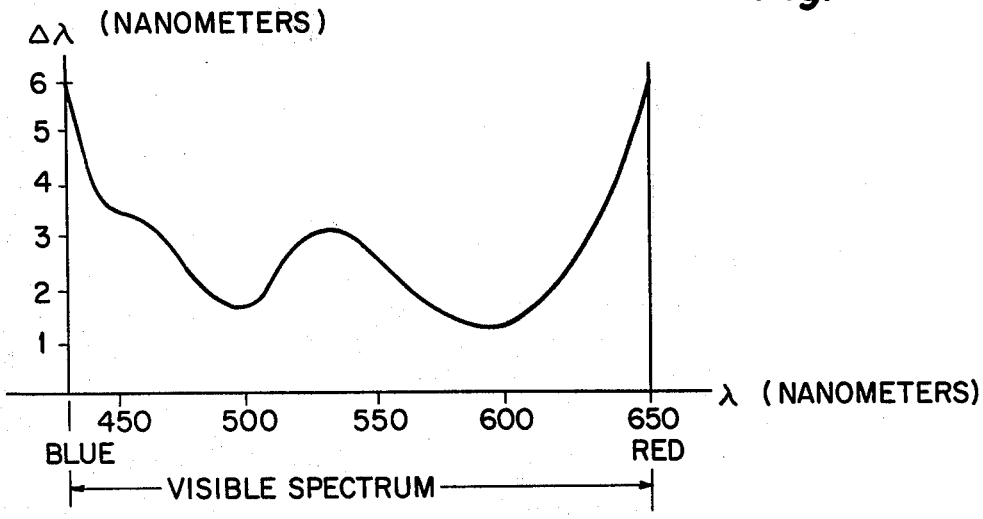
FIG. 6 is a graph plotting the visible spectrum versus noticeable color differentiation.

Referring now to the curve of FIG. 6, the abscissa depicts the visible color spectrum beginning with the ultra violet or blue at approximately 410 nanometers wave length extending to the opposite end of the visible color spectrum in which the beginning of infrared starts at about 660 nanometers and wave length. Tests have been made to determine perceptible color differences to the human eye for each of these wave lengths wherein the noticeable difference distinguishable by the human eye is plotted on the ordinant of the graph. Hence the ordinant represents the noticeable color difference compared to the various color wave lengths.

It has further been determined that objects illuminated by light having a tinge of yellow represented by approximately 540 nanometers is less distinguishable than light which has a tinge of yellow and is then mixed with blue. The central beam pattern produced by the opaque coated bulb as shown in FIG. 5 provides substantially white light in the center portion thereof where the outer edges thereof will be tinged yellow.

On the blue coated bulb as shown in FIG. 4, blue light is mixed with this yellow tinge which produces a slightly blue green color which yields better color differentiation. Tests have indicated that color identification using the blue coated bulb is better by approximately 30 to 35% over the black coated bulb. However, as stated above, the primary purpose of the opaque coating as taught in the present invention is to reduce glare and provide a more acutely defined beam pattern which can be played on the roadway immediately ahead of the vehicle.

Figure 7:
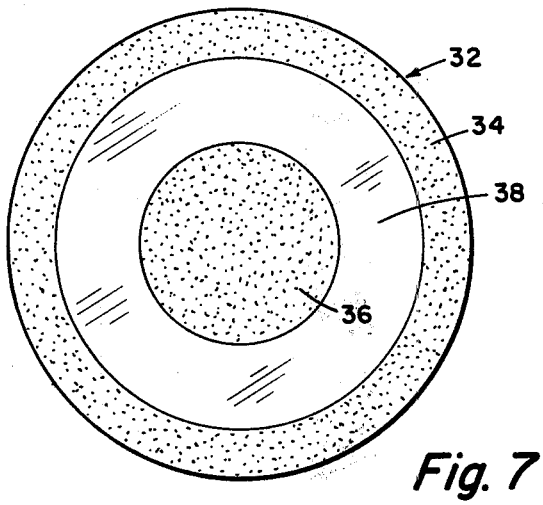
FIG. 7 is an elevational front view of an alternate embodiment of the invention.

Referring now to FIG. 7, a second embodiment of the bulb is identified by reference character 32 in which the outer peripheral opaque coating 34 and the central opaque coating 36 is circular in shape thereby providing an annular clear aperture 38. Naturally the circular pattern may be considered as a special case of ellipse in which the eccentricity is zero.

It should be noted that other lenses than those described herein may require the peripheral and central coating to take on shapes different from the elliptical and circular shapes described and can best be determined by optical testing.

From the foregoing, it is apparent that the present invention provides a lamp which is particularly designed to produce an acute beam pattern and wherein the peripheral illumination or incident light has been greatly curtailed which results in reduced glare in adverse visibility conditions.

Whereas, the present invention has been described in particular relation to the drawings attached hereto, other and further modifications apart from those shown or suggested herein may be made within the spirit and scope of the invention.

What is claimed is:

1. A modified lamp for emitting a beam of light, the lamp having a parabolic reflector, a light emitter located near the focus of the parabolic reflector, and a lense element covering the reflector and the light emitter; the modification comprising the lense element having two selected areas of opaque coating for reducing peripheral glare thereby shaping the beam pattern, the first area of opaque being around the outer periphery of the lense element, the second area of opaque coating covering the center portion of the lense element leaving a light aperture area interposed between the first and second areas of opaque coating, the first and second areas of opaque coating being shaped to cooperate with the lense element structure to reduce the outer periphery of light emitted from the lamp.

2. A lamp as set forth in claim 1 wherein the light aperture area is annular in shape.

3. A lamp as set forth in claim 1 wherein the opaque coating is black.

4. A lamp as set forth in claim 1 wherein the outer surface of the lense element is frosted over the said two select areas and the opaque coating is black pigment superimposed over the frosted area.

5. A lamp as set forth in claim 1 wherein the plane of the lense element is substantially vertical in use and wherein the light aperture is elliptical in shape.

6. A lamp as set forth in claim 5 wherein the opaque coating is black.

7. A vehicle driving lamp comprising a lamp for producing a beam of light directed forward of the vehicle, the lamp having a lense element, a first area of opaque coating provided around the outer portion of the lense element leaving an elliptical uncoated area interior of said first coated area, a second elliptical shaped area of opaque coating being concentrically disposed within the elliptical uncoated area forming an aperture between said coated areas which is also elliptical in shape.

8. A vehicle driving lamp as set forth in claim 7 wherein the lense element is frosted over the first and second areas of opaque coating and the opaque coating is black pigment superimposed over the frosted areas.

9. A vehicle driving lamp as set forth in claim 8 wherein the elliptical shaped light aperture has eccentricity of zero.

10. A modified lamp as set forth in claim 5 wherein the areas of opaque coating are shaped to particularly reduce the upper portion of the outer periphery of the beam of light emitted from the lamp.

11. A modified lamp as set forth in claim 5 wherein the areas of opaque coating are shaped to particularly reduce one side of the beam of light emitted from the lamp.

12. A modified lamp as set forth in claim 5 wherein the areas of opaque coating are shaped to particularly reduce the upper portion and one side portion of the outer periphery of the beam of light emitted from the lamp.

13. A modified lamp as set forth in claim 12 wherein the major axis of the eliptically shaped light aperture is horizontal.

* * * * *